US010119750B2

(12) United States Patent
Kim

(10) Patent No.: US 10,119,750 B2
(45) Date of Patent: Nov. 6, 2018

(54) DISPENSER ASSEMBLY FOR REFRIGERATOR

(71) Applicant: Dongbu Daewoo Electronics Corporation, Seoul (KR)

(72) Inventor: Dong Sun Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/471,916

(22) Filed: Mar. 28, 2017

(65) Prior Publication Data

US 2017/0307284 A1 Oct. 26, 2017

(30) Foreign Application Priority Data

Apr. 26, 2016 (KR) ..... 10-2016-0050797

(51) Int. Cl.

| | |
|---|---|
| ***F25D 23/12*** | (2006.01) |
| ***F25D 23/02*** | (2006.01) |
| ***F25C 5/20*** | (2018.01) |
| *B67D 1/00* | (2006.01) |

(52) U.S. Cl.

CPC ..... *F25D 23/126* (2013.01); *F25C 5/22* (2018.01); *F25D 23/028* (2013.01); *B67D 1/0009* (2013.01); *B67D 2210/00036* (2013.01); *F25D 2500/02* (2013.01)

(58) Field of Classification Search

CPC ..... F25D 23/126; B67D 2210/00036

See application file for complete search history.

(56) References Cited

U.S. PATENT DOCUMENTS

| | | | | |
|---|---|---|---|---|
| 2,512,395 | A * | 6/1950 | Sundberg | F25D 23/126 222/182 |
| 5,366,117 | A * | 11/1994 | Mesenbring | B67D 1/0004 222/132 |
| 5,881,930 | A * | 3/1999 | Lee | B67D 3/0025 222/509 |
| 7,007,500 | B2 * | 3/2006 | Lee | F25C 5/005 222/146.6 |
| 2008/0184730 | A1 * | 8/2008 | Voglewede | F25D 23/126 62/389 |
| 2010/0307184 | A1 * | 12/2010 | Jung | F25D 23/126 62/389 |
| 2016/0370100 | A1 * | 12/2016 | Kim | F25C 5/005 |
| 2017/0305730 | A1 * | 10/2017 | Kim | B05B 12/002 |

FOREIGN PATENT DOCUMENTS

KR 10-0277578 B1 1/2001

* cited by examiner

*Primary Examiner* — J. Casimer Jacyna

(57) ABSTRACT

A dispenser assembly for a refrigerator including a removable discharge nozzle. The dispenser assembly includes a dispenser body, a water supply flow path and a removable discharge nozzle removably supported by a storage part formed in the dispenser body. The removable discharge nozzle is coupled to an extension hose can be pulled out of the dispenser body by a user for dispensing water. The removable discharge nozzle includes a discharge flow path, a rotating shaft installed in the discharge flow path, an opening/closing member, and a discharge button for user manipulation.

12 Claims, 5 Drawing Sheets

DISPENSER ASSEMBLY FOR REFRIGERATOR

CROSS-REFERENCE TO RELATED APPLICATION

This application is based on and claims priority from Korean Patent Application No. 10-2016-0050797, filed on Apr. 26, 2016, the disclosure of which is incorporated herein in its entirety by reference for all purposes.

TECHNICAL FIELD

Embodiments of the present disclosure relate to refrigerators, and more particularly, to water dispensers in refrigerators.

BACKGROUND

A refrigerator is an appliance used for storing food or other times at low temperature, e.g., in a frozen state or refrigerated state. Typically, the storage space in the refrigerator is divided into a refrigeration compartment and a freezer compartment.

Some refrigerators are equipped with a water purifier and an ice maker. The ice maker may be installed in any one of a freezer compartment, a refrigeration compartment and a door.

In some refrigerators, a dispenser can dispense both water and ice. The dispenser can be installed on the outer side of a refrigerator door.

As illustrated in FIG. 1, conventionally, a dispenser body 12 is disposed in a recess on a door. More specifically, an ice discharge port 14, an ice guide 16, a water discharge port 18, a water discharge lever 11 and an ice discharge lever 13 may be disposed in the recess.

For example, the ice discharge port 14 is formed at one side of a dispenser body 12 (e.g., at the inner side of the recess.) The ice guide 16 is coupled to an end of the ice discharge port 14. The water discharge port 18 is formed at another side of the dispenser body 12 (e.g., at the outer side of the recess). In this regard, the ice discharge port 14 and the water discharge port 18 are fixed to the recess on the door.

The water discharge lever 11 that opens and closes the water discharge port 18 is mounted at the outer side of the ice guide 16. The ice discharge port 14 for ejecting ice, the ice guide 16 and the ice discharge lever 13 are mounted on the inner wall of the recess.

However, as the water discharge port is fixed on the dispenser, a user may find it difficult to fit a container into the recess to receive water or ice, for example, because the container does not fit in the recess.

PRIOR ART DOCUMENTS

Patent Documents

Patent Document 1: U.S. Pat. No. 7,874,460 (issued on Feb. 25, 2011)

SUMMARY

Embodiments of the present disclosure provide a dispenser assembly for a refrigerator that includes a removable discharge nozzle for dispensing water.

In accordance with one embodiment, the dispenser assembly includes: a dispenser body; a water supply flow path disposed in the dispenser body; a fixed discharge unit fixedly installed in the dispenser body and configured to selectively discharge water received from the water supply flow path; a removable discharge nozzle removably installed in an accommodation portion formed in the dispenser body and configured to selectively discharge water supplied from the water supply flow path; and an extension hose configured to interconnect the water supply flow path and the removable discharge nozzle so that the removable discharge nozzle can be drawn out from the accommodation portion. The water supply flow path is branched toward the fixed discharge unit and the removable discharge nozzle. The removable discharge nozzle includes a discharge body having a discharge flow path through which water flows. A rotating shaft is installed in the discharge flow path. An opening/closing member is disposed in the rotating shaft to selectively open the discharge flow path. A discharge button is configured to rotate the opening/closing member to open the discharge flow path.

The removable discharge nozzle may include: an elastic member configured to keep the opening/closing member in a closed state with respect to the discharge flow path; an opening/closing bar protruding from the opening/closing member so that the discharge flow path is opened when the opening/closing bar is pushed by the discharge button; and a sealing member disposed on an outer circumferential surface of the opening/closing member.

The fixed discharge unit may include: a fixed discharge port disposed in the dispenser body and connected to the water supply flow path; and a water discharge lever configured to mechanically open and close the fixed discharge port.

The dispenser assembly may further include: a winding accommodation portion disposed in the dispenser body to wind and accommodate the extension hose.

The dispenser assembly may further include: an ice supply flow path disposed in the dispenser body; and an ice discharge unit fixedly installed in the dispenser body and configured to selectively discharge ice supplied from the ice supply flow path.

The ice discharge unit may include: an ice discharge port disposed in the dispenser body; an ice guide installed at an end of the ice discharge port; and an ice discharge lever configured to electively eject ice from the ice discharge port.

According to the embodiments of the present disclosure, users can advantageously use the removable discharge nozzle to receive water outside the dispenser recess and use any container despite the geometry limitation of the recess. Users can also receive water by placing a container in the dispenser recess. The removable discharge nozzle has a mechanical valve for easy control by users.

DETAILED DESCRIPTION

Figure 1:
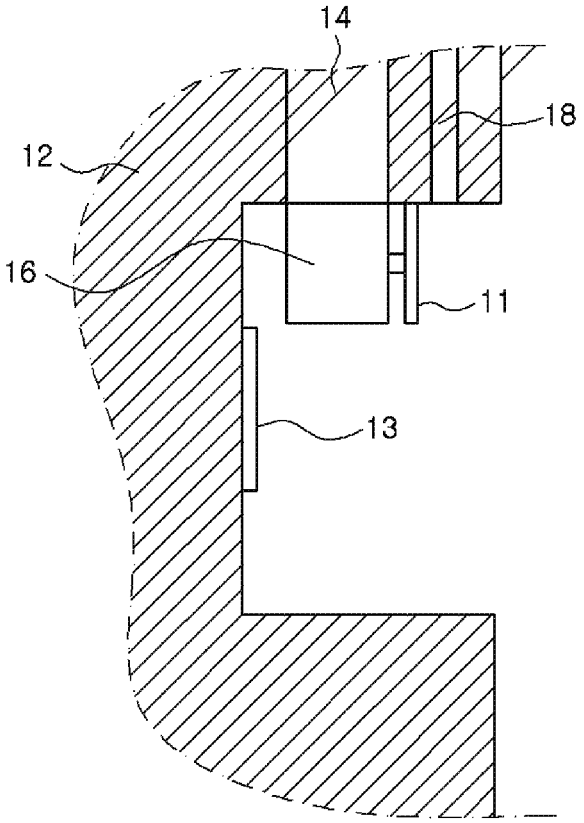
FIG. 1 (RELATED ART)
FIG. 1 is a side sectional view of a dispenser installed in a conventional refrigerator.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form due to manufacturing.

Figure 2:
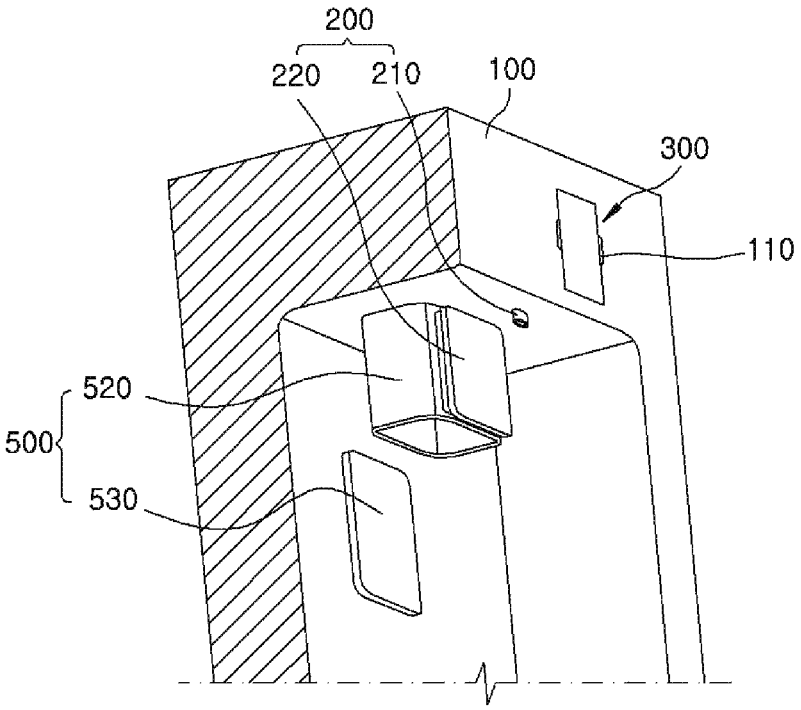
FIG. 2 is a perspective view illustrating a state in which a removable discharge nozzle is coupled to a dispenser body in an exemplary dispenser assembly of a refrigerator according to one embodiment of the present disclosure.
Figure 3:
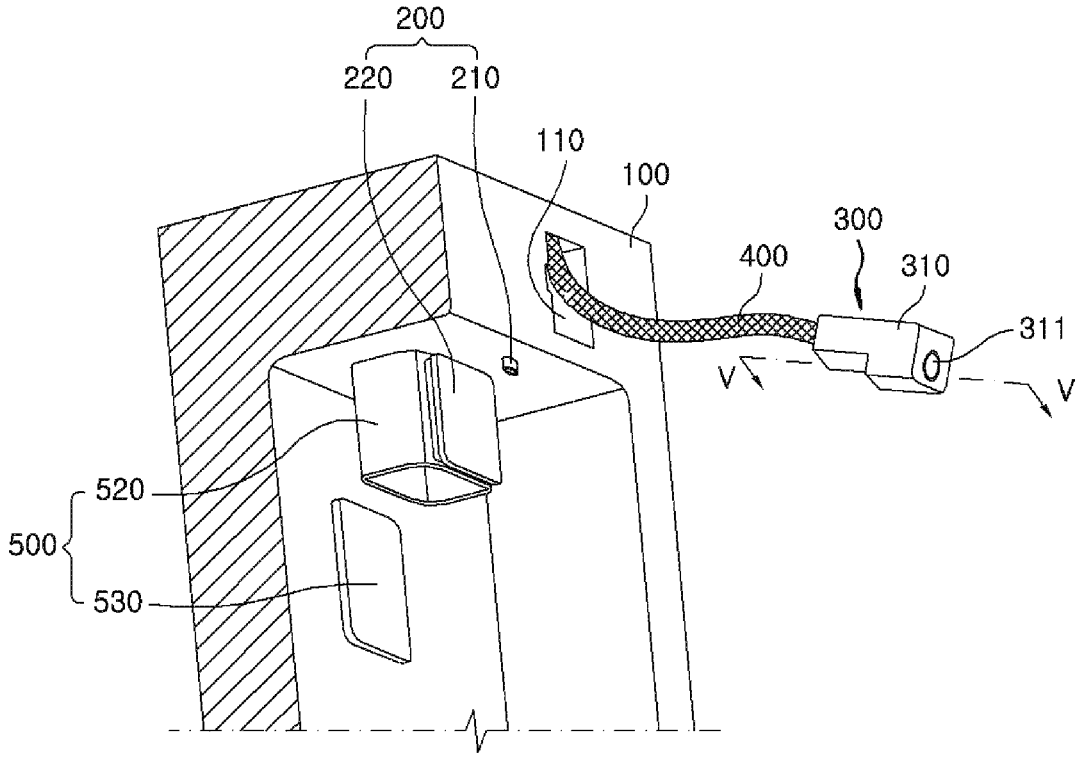
FIG. 3 is a perspective view illustrating a state in which the exemplary removable discharge nozzle is removed from the dispenser body in the dispenser assembly according to one embodiment of the present disclosure.
Figure 4:
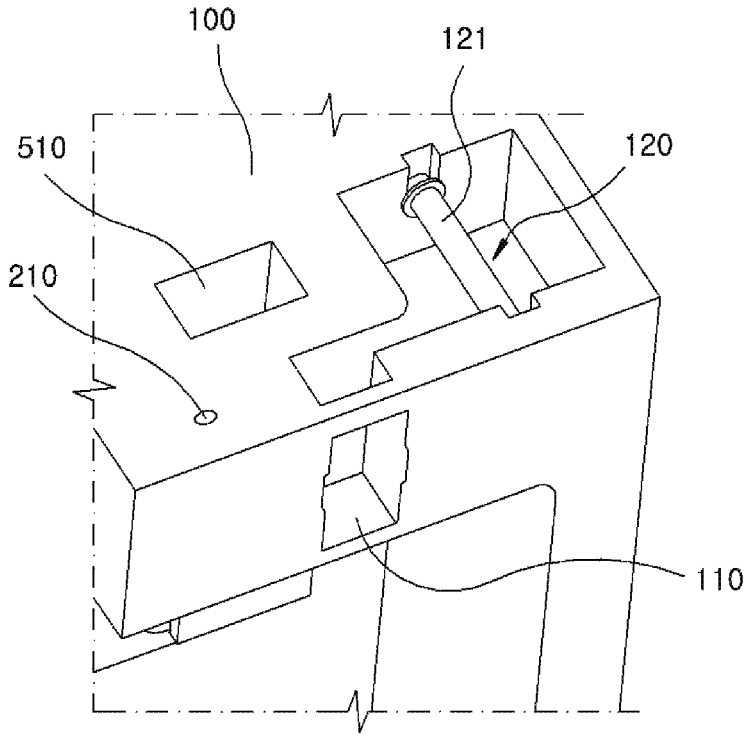
FIG. 4 is a partial perspective view illustrating the configuration of an exemplary winding accommodation portion in which an extension hose according to one embodiment of the present disclosure is accommodated.
Figure 5:
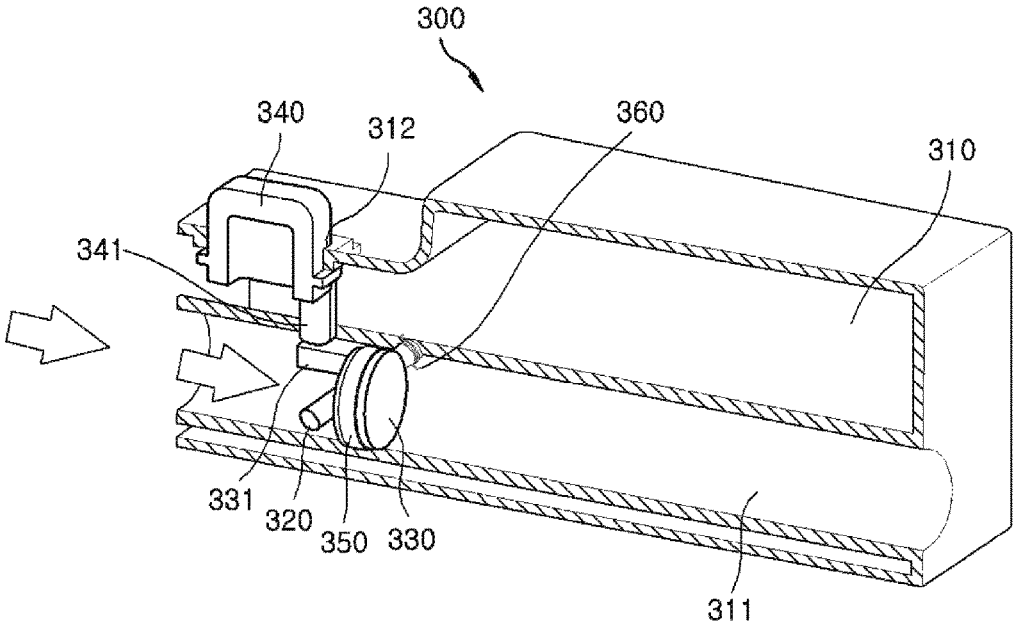
FIG. 5 is a partially cutaway perspective view taken along line V-V in FIG. 3.
Figure 6:
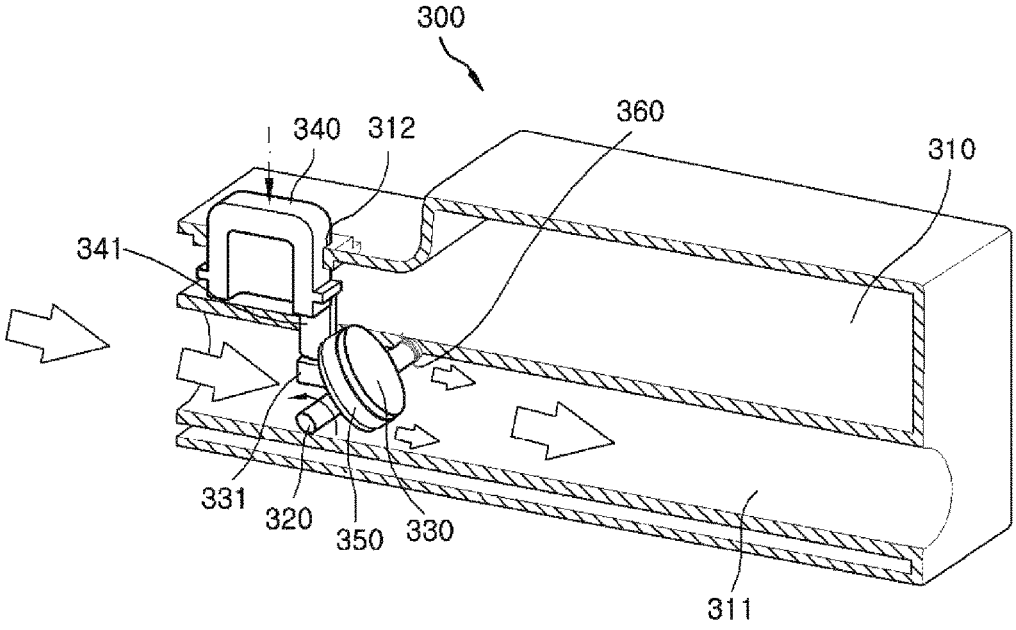
FIG. 6 is a view illustrating a state in which water is discharged through the removable discharge nozzle in the dispenser assembly for a refrigerator according to one embodiment of the present disclosure.

FIG. 2 is a perspective view illustrating a state in which a removable discharge nozzle is coupled to a dispenser body in an exemplary dispenser assembly of a refrigerator according to one embodiment of the present disclosure. FIG. 3 is a perspective view illustrating a state in which the exemplary removable discharge nozzle is removed from the dispenser body in the dispenser assembly according to one embodiment of the present disclosure. FIG. 4 is a partial perspective view illustrating the configuration of an exemplary winding accommodation portion in which an extension hose according to one embodiment of the present disclosure is accommodated. FIG. 5 is a partially cutaway perspective view taken along line V-V in FIG. 3. FIG. 6 is a view illustrating a state in which water is discharged through the removable discharge nozzle in the dispenser assembly for a refrigerator according to one embodiment of the present disclosure.

As illustrated in FIGS. 2 to 6, the dispenser assembly for a refrigerator according to one embodiment of the present disclosure may include a dispenser body 100, a water supply flow path, a fixed discharge unit 200, a removable discharge nozzle 300, an extension hose 400, an ice supply flow path, and an ice discharge unit 500.

More specifically, the dispenser body 100 may be disposed at the outer front surface of a door of a refrigerator. A water supply flow path configured to guide water supplied from a purifier toward the fixed discharge unit 200 and/or the removable discharge nozzle 300 and an ice supply flow path configured to guide ice supplied from an ice maker toward the ice discharge unit 500 may be disposed within the dispenser body 100.

A groove-shaped recess depresses inward on the door to receive a container that may be disposed in the dispenser body 100. The recess defines a space for dispensing water or ice to a user. The recess may be positioned in a lower portion of a front surface of the dispenser body 100. The fixed discharge unit 200 and the ice discharge unit 500 may be disposed in the recess and they may be partially exposed.

An accommodation portion 110, in which the removable discharge nozzle 300 can be securely placed, may be disposed in the dispenser body 100. The accommodation portion 110 may be positioned in an upper portion of the front surface of the dispenser body 100 and may accommodate the removable discharge nozzle 300. The accommodation portion 110 is in communication with a winding accommodation portion 120. Thus, the removable discharge nozzle 300 may be connected to a winding roller 121 of the winding accommodation portion 120 via the extension hose 400.

The winding accommodation portion 120 is an accommodation space for winding and accommodating the extension hose 400 when the removable discharge nozzle 300 is placed back to the accommodation portion 110. The winding roller 121 is configured to automatically wind the extension hose 400 and may be mounted at the center of the winding accommodation portion 120.

Thus, when the removable discharge nozzle 300 is removed from the accommodation portion 110, the extension hose 400 can be pulled out from the winding roller 121.

When the removable discharge nozzle 300 is placed back to the accommodation portion 110, the extension hose 400 may be automatically wound around the winding roller 121.

The water supply flow path (not shown) is a water flow path for delivering water supplied from a purifier of the refrigerator to the fixed discharge unit 200 and/or the removable discharge nozzle 300. The water supply flow path may be branched into or may communicate with a fixed discharge port 210 of the fixed discharge unit 200 and a discharge flow path 311 of the removable discharge nozzle 300.

Thus, water supplied from the purifier may be supplied to the fixed discharge port 210 of the fixed discharge unit 200 via the water supply flow path or may be supplied to the discharge flow path 311 of the removable discharge nozzle 300 via the water supply flow path.

The fixed discharge unit 200 may be fixed to the front side of the dispenser body 100 and may supply water to a container accommodated within the recess. For this purpose, the fixed discharge unit 200 may include the fixed discharge port 210 that is positioned on an inner upper surface of the recess and coupled to the water supply flow path, and a water discharge lever 220 operable to open and close the fixed discharge port 210.

The water discharge lever 220 may be coupled to a mechanical opening/closing valve which can mechanically open the fixed discharge port 210 responsive to user operations on the lever. It will be appreciated by those skilled in the art that, in addition to the mechanical opening/closing valve, an electronic opening/closing valve can also be used to open the fixed discharge port 210 in response to an electrical signal.

The removable discharge nozzle 300 may be removably installed in the accommodation portion 110 of the dispenser body 100 and may selectively discharge the water supplied from the water supply flow path through the extension hose 400.

The removable discharge nozzle 300 may include a discharge body 310, a rotating shaft 320, an opening/closing member 330, an discharge button 340, an elastic member 360, an opening/closing bar 331 and a sealing member 350.

In this regard, the discharge body 310 may have a housing shape conformal to the groove shape of the accommodation portion 110. The discharge body 310 can be securely placed in the accommodation portion 110 of the dispenser body 100. The discharge flow path 311, into which water in the water supply flow path is supplied, may be formed to extend through the discharge body 310. A mounting opening 312, to which the discharge button 340 is movably mounted, may be formed in one sidewall of the discharge body 310.

The rotating shaft 320 is rotatably installed in the discharge flow path 311. The opening/closing member 330 may be mounted to the rotating shaft 320. For example, the opposite end portions of the rotating shaft 320 may be rotatably installed in the inner wall of the discharge flow path 311. The opening/closing member 330 may be fixed to the central portion of the rotating shaft 320.

The opening/closing member 330 has a substantially circular disk shape to selectively open or close the discharge flow path 311 along with the rotation of the rotating shaft 320. The opening/closing member 330 has an outer diameter equal to an inner diameter of the discharge flow path 311.

The opening/closing bar 331 can be pushed by a button bar 341 of the discharge button 340 and may be disposed on one side surface of the opening/closing member 330. The opening/closing bar 331 may extend from one surface of the opening/closing member 330 so that the opening/closing bar 331 is positioned on a movement route of the button bar 341 of the discharge button 340.

The sealing member 350 has a ring shape and may be disposed on an outer circumferential surface of the opening/closing member 330. When the discharge flow path 311 is closed by the opening/closing member 330, the sealing member 350 may seal the gap between an outer circumferential surface of the opening/closing member 330 and an inner circumferential surface of the discharge flow path 311, thereby preventing water leakage which may otherwise occur due to the gap.

The discharge button 340 is configured to push the opening/closing bar 331 to rotate the opening/closing member 330. The discharge button 340 may be movably installed in one sidewall of the discharge body 310. The button bar 341 configured to push the opening/closing bar 331 of the opening/closing member 330 when the discharge button 340 is pushed may extend from an end portion of the discharge button 340.

The elastic member 360 may be a torsion spring configured to restore the rotating shaft 320 to an original position. The elastic member 360 may apply a biasing force to the rotating shaft 320 to keep the opening/closing member 330 in a closed state.

The extension hose 400 is configured to interconnect the water supply flow path and the removable discharge nozzle 300. The extension hose 400 may be made of a flexible material which can be extended and contracted. The extension hose 400 may be wound around by the winding roller 121.

Thus, if the removable discharge nozzle 300 is removed from the accommodation portion 110, the extension hose 400 may be drawn out from the winding accommodation portion 120. If the pulling force on the removable discharge nozzle 300 is released, the extension hose 400 may be drawn into the winding accommodation portion 120 by the winding action of the winding roller 121 and thereby may be automatically wound around the winding roller 121.

The ice supply flow path (not shown) is a flow path configured to deliver the ice supplied from the ice maker of the refrigerator to the ice discharge unit 500. The ice supply flow path may be in communication with the ice discharge unit 500, more specifically the ice discharge port 510 of the ice discharge unit 500.

The ice discharge unit 500 may be positioned between the inner wall of the recess of the dispenser body 100 and the fixed discharge unit 200 and may selectively discharge the ice supplied from the ice supply flow path. In the present embodiment, the ice discharge unit 500 is disposed at the inner side of the recess and the fixed discharge unit 200 is disposed at the outer side of the recess. However, it will be appreciated that the arrangement of the ice discharge unit 500 and the fixed discharge unit 200 may vary in different embodiments.

The ice discharge unit 500 may include the ice discharge port 510 disposed in the dispenser body 100 to communicate with the ice supply flow path, an ice guide 520 installed at the end of the ice discharge port 510, and an ice discharge lever 530 operable to selectively discharge ice from the ice discharge port 510.

In this regard, the ice guide 520 may extend from the end of the ice discharge port 510 by a certain length and may guide the ice discharged from the ice discharge port 510 toward the lower side of the recess.

The ice discharge lever 530 is a push button configured to activate or deactivate an ice discharge operation. The ice discharge lever 530 may be mounted to the inner wall of the recess. At the rear side of the ice discharge lever 530, there may be disposed a switch (not shown) configured to generate a push sensing signal to open the ice discharge port 510 when the pushing of the ice discharge lever 530 is sensed, and a spring (not shown) configured to automatically restore the ice discharge lever 530 to an original position when the ice discharge lever 530 is released.

The present embodiment uses an opening/closing system to control the discharge flow path 311, in which the rotating shaft 320 is returned to the original position upon the discharge button 340 being released. However, the present disclosure is not limited thereto. Different kinds of opening/closing systems may be used to control the flow path to the removable discharge nozzle 300. For example, the discharge flow path 311 may be opened and closed solely by elastic force of the elastic member 360 and without using any rotating shaft.

The operation of the dispenser assembly configured as above is described.

When a user wishes to receive water by inserting a container into the recess of the dispenser body 100, it may be difficult to insert the container into the recess, e.g., because the container is larger than the recess.

In this case, if the removable discharge nozzle 300 is removed from the accommodation portion 110 of the dispenser body 100 and is pulled away from the dispenser body 100, the extension hose 400 is drawn out from the winding accommodation portion 120. This allows the user to catch water outside the recess.

At this time, if the discharge button 340 of the removable discharge nozzle 300 is pushed, the button bar 341 of the discharge button 340 pushes the opening/closing bar 331 of the opening/closing member 330. The opening/closing member 330 pushed by the opening/closing bar 331 is rotated together with the rotating shaft 320 (e.g., counter-clockwise in FIG. 6), thereby opening the discharge flow path 311. Water flowing from the water supply flow path may pass through the extension hose 400 and then may be discharged through the discharge flow path 311 in the removable discharge nozzle 300.

If the discharge button 340 is released, the elastic member 360 returns the rotating shaft 320 to the original position. At this time, the opening/closing member 330 may close the discharge flow path 311 due to the rotation (clockwise rotation in FIG. 5) of the rotating shaft 320. Furthermore, the discharge button 340 may return to its original position.

Thereafter, if the pulling of the removable discharge nozzle 300 is released, the extension hose 400 may be drawn into the winding accommodation portion 120 by the winding action of the winding roller 121 and may be wound around the winding roller 121.

In this way, a user may remove the removable discharge nozzle 300 from the accommodation portion 110 and extend the extension hose 400. The user may then push the discharge button 340 of the removable discharge nozzle 300 to receive water, e.g., using a container. This allows the user to advantageously dispense water outside the recess and use any container despite the geometry limitation of the recess.

On the other hand, if a user wishes to dispense water by putting a container into the recess of the dispenser body 100, the water discharge lever 220 can be pushed once the container is inserted into the recess. In response, the fixed discharge port 210 is opened to dispense water.

If a user wishes to receive ice by putting a container into the recess of the dispenser body 100, the ice discharge lever 530 can be pushed once the container is inserted into the recess. In response, the ice discharge port 510 is opened, which enables the user to receive ice from the ice discharge port 510.

As described above, according to the embodiments of the present disclosure, users can advantageously use the removable discharge nozzle to receive water outside the dispenser recess and use any container despite the geometry limitation of the recess. Users can also receive water by placing a container in the dispenser recess. The removable discharge nozzle has a mechanical valve for easy control by users.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only exemplary. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A dispenser assembly for a refrigerator, the dispenser assembly comprising:

a dispenser body comprising an accommodation portion;

a fixed discharge unit fixedly installed in the dispenser body and configured to selectively discharge water supplied from a water supply flow path;

a removable discharge nozzle removably installed in the accommodation portion and configured to selectively discharge water supplied from the water supply flow path;

an extension hose configured to interconnect the water supply flow path and the removable discharge nozzle, wherein the removable discharge nozzle comprises:

a discharge flow path operable to communicate with the extension hose;

a rotating shaft installed in the discharge flow path; an opening/closing member fixed to the rotating shaft and operable to control an opening of the discharge flow path;

a discharge button configured to rotate the opening/closing member to open the discharge flow path;

an elastic member configured to maintain the opening/closing member in a closed state;

an opening/closing bar protruding from the opening/closing member, wherein the opening/closing member is operable to open the discharge flow path responsive to the opening/closing bar being pushed by the discharge button; and a sealing member disposed on an outer circumferential surface of the opening/closing member.

2. The dispenser assembly of claim 1, wherein the fixed discharge unit comprises:

a fixed discharge port disposed in the dispenser body and coupled to the water supply flow path; and a water discharge lever operable to open and close the fixed discharge port.

3. The dispenser assembly of claim 1 further comprising:

a winding accommodation portion provided in the dispenser body to accommodate the extension hose; and a winding roller installed at the winding accommodation portion and configured to wind the extension hose.

4. The dispenser assembly of claim 1, further comprising:

an ice supply flow path disposed in the dispenser body; and an ice discharge unit fixedly installed in the dispenser body and configured to selectively discharge ice supplied from the ice supply flow path.

5. The dispenser assembly of claim 4, wherein the ice discharge unit comprises:

an ice discharge port disposed in the dispenser body;

an ice guide installed at an end of the ice discharge port; and an ice discharge lever operable to selectively discharge ice from the ice discharge port.

6. A refrigerator comprising:

a door operable to seal a storage space; and a dispenser assembly coupled to the door and comprising:

a dispenser body comprising an accommodation portion;

a fixed discharge unit fixedly installed in the dispenser body and configured to selectively discharge water supplied from a water supply flow path;

a removable discharge nozzle removably installed in the accommodation portion and configured to discharge water supplied from the water supply flow path; and an extension hose configured to interconnect the water supply flow path and the removable discharge nozzle, wherein the removable discharge nozzle comprises:

a discharge flow path that communicates with the extension hose;

a rotating shaft installed in the discharge flow path; an opening/closing member fixed to the rotating shaft and operable to control an opening of the discharge flow path;

a discharge button configured to rotate the opening/closing member to open the discharge flow path;

an elastic member configured to maintain the opening/closing member in a closed state;

an opening/closing bar protruding from the opening/closing member, wherein the opening/closing member is operable to open the discharge flow path responsive to the opening/closing bar being pushed by the discharge button; and a sealing member disposed on an outer circumferential surface of the opening/closing member.

7. The refrigerator of claim 6, wherein the fixed discharge unit comprises:

a fixed discharge port disposed in the dispenser body and coupled to the water supply flow path; and a water discharge lever operable to open and close the fixed discharge port.

8. The refrigerator of claim 6, wherein the dispenser assembly further comprises:

a winding accommodation portion provided in the dispenser body to accommodate the extension hose; and a winding roller installed at the winding accommodation portion and configured to wind the extension hose.

9. The refrigerator of claim 6 further comprising:

an ice supply flow path disposed in the dispenser body; and an ice discharge unit fixedly installed in the dispenser body and configured to selectively discharge ice supplied from the ice supply flow path.

10. The dispenser assembly of claim 9, wherein the ice discharge unit comprises:

an ice discharge port disposed in the dispenser body;

an ice guide installed at an end of the ice discharge port; and an ice discharge lever operable to selectively discharge ice from the ice discharge port.

11. The dispenser assembly of claim 1, wherein the ice discharge lever is a push button configured to activate or deactivate an ice discharge operation, and wherein the ice discharge unit further comprises:

a switch disposed at a rear side of the ice discharge lever, the switch being configured to generate a push sensing signal to open the ice discharge port when the pushing of the ice discharge lever is sensed; and a spring configured to automatically restore the ice discharge lever to an original position when the ice discharge lever is released.

12. The dispenser assembly of claim 1, wherein an opening of the discharge flow path does not exposed outside when the removable discharge nozzle installed in the accommodation of the dispenser body.

* * * * *